United States Patent [19]

Arkind et al.

[11] 4,016,570

[45] Apr. 5, 1977

[54] CONSTANT BEAM WIDTH ANTENNA REFLECTOR

[75] Inventors: Kenneth D. Arkind, Groton, Mass.; Bernard L. Geddry, Nashua, N.H.

[73] Assignee: Sanders Associates, Inc., Nashua, N.H.

[22] Filed: Feb. 5, 1976

[21] Appl. No.: 655,344

[52] U.S. Cl. ..... 343/781 R; 343/840

[51] Int. Cl.[2] ..... H01Q 19/12

[58] Field of Search ..... 343/781, 840, 912, 914

[56] References Cited

OTHER PUBLICATIONS

Williams; High Efficiency Antenna Reflector; Microwave Journal; July, 1965, pp. 79–82.

*Primary Examiner*—Eli Lieberman

*Attorney, Agent, or Firm*—Louis Etlinger; Joseph E. Funk

[57] ABSTRACT

A universal antenna reflector providing a constant beam width pattern for any frequency of reflected electromagnetic energy illuminating the reflector is disclosed. The constant beam width reflected pattern is determined only by the characteristics of a particular antenna illuminating the reflector. The reflector is described by a family of curves the physical centers of each of which are coincident with and distributed along a unique backbone curve with each of the family of curves being perpendicular thereto.

8 Claims, 3 Drawing Figures

CONSTANT BEAM WIDTH ANTENNA REFLECTOR

FIELD OF INVENTION

This invention relates to a reflector suitable for use in an antenna system for the reception or transmission of electromagnetic energy.

BACKGROUND OF THE INVENTION

In the prior art there has been a need for antenna systems having substantially uniform and highly efficient electrical transmission characteristics, and more particularly a need for constant beam width patterns at substantially any frequency of operation of the antenna system. There are presently two main types of antennas that are somewhat frequency independent. These systems utilize two types of antennas: log periodic and spiral antennas. Spiral antennas do provide constant beam width patterns over wide frequency ranges of operation, but spiral antennas suffer certain shortcomings. This type of antenna can only operate at low power levels, has low efficiency, and exhibits wide beam width patterns that result in a lack of directivity and low antenna gain. Log periodic antennas are an improvement over spiral type antennas and have increased directivity due to somewhat narrower beam width patterns and this results in a medium gain antenna. However, log periodic type antennas can only handle medium power levels and have a beam width pattern that varies with frequency to a degree that is unacceptable in some applications. In addition, log periodic antennas do not function well above an operating frequency of 12 gigahertz.

To improve upon the characteristics of spiral antennas and log periodic antennas, conventional reflectors have been used therewith which are well known in the art. The spiral type antenna coupled with a reflector causes pattern beam width to be narrowed somewhat resulting in improved directivity and higher gain, but this combination still results in low power handling capability and low efficiency due to the limitation of the spiral antenna illuminating the reflector.

The combination of log periodic type antennas with conventional reflectors also results in narrower beam width patterns giving increased directivity hence higher gain, but this combination can only operate at medium power levels and still cannot operate above 12 gigahertz due to the limitation of the log periodic type antenna illuminating the reflector. In addition, the pattern beam width of a log periodic type antenna varies somewhat with frequency. The factor combined with the shift in phase center along the length of a log periodic type antenna with changing frequency, causes pattern disruptions that are often unacceptable.

Although there are improvements in some antenna system electrical characteristics in combining a conventional reflector with either a spiral type antenna or a log periodic type antenna there is no longer a constant pattern beam width over large frequency ranges of operation.

Accordingly, there is a need in the art for a new antenna reflector that gives constant beam width patterns over wide frequency ranges of operation of an antenna while providing high directivity and gain, with power handling capability and efficiency determined solely by the feed antenna illuminating the reflector.

SUMMARY OF THE INVENTION

In accordance with the teaching of our invention we provide a novel antenna reflector which can provide constant beam width pattern over a very wide range of frequencies of electromagnetic energy illuminating the reflector and is limited only by the physical size of the reflector and the electrical characteristics of the electromagnetic energy radiator illuminating our novel reflector. Our novel reflector can work with any typical radiator normally used in reflector type antenna systems for all electromagnetic frequencies up to and including the very highest microwave frequencies which can be generated by those most highly skilled in the ultrahigh microwave frequency art. The operational characteristics of an antenna system using our novel reflector is limited not by the reflector, except for mechanical tolerances in the manufacture thereof and its overall size, but rather by the electrical characteristics of any specific electromagnetic radiator illuminating our reflector.

Our novel reflector is a surface described by a family of rib like curves, each curve lying in its own plane, with the physical center of each of the family of curves being coincident with a point on a unique backbone like curve we have designed, such that the planes containing each of the family of curves are orthogonal to the plane containing the unique curve.

The electromagnetic radiator illuminating our novel reflector is located at the focal point of the unique backbone curve of the surface of the reflector and, as recognized by one skilled in the art, the edges of the reflector surface are shaped such that the electromagnetic radiator advantageously illuminates the reflector so that the illuminating power levels around the edge of the reflector surface are substantially equal.

Our invention will be more fully understood by reading the following detailed description in conjunction with the drawing in which.

DETAILED DESCRIPTION

Figure 1:
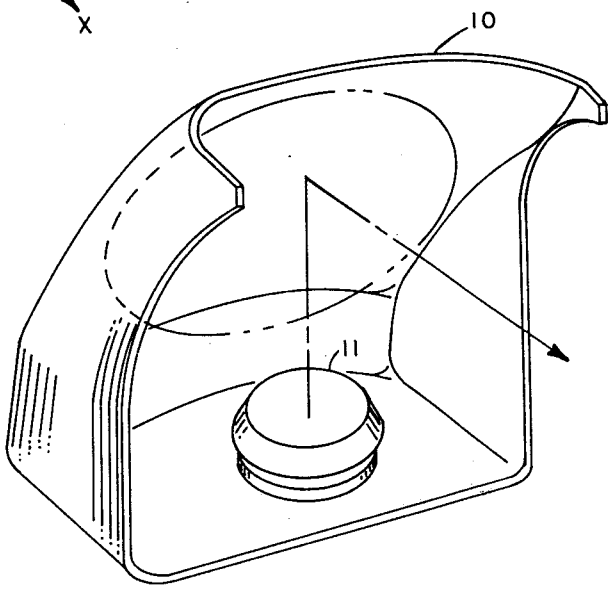
FIG. 1 is a perspective view of our antenna system reflector in accordance with the preferred embodiment of our invention.

Referring to FIG. 1, therein is shown a perspective view of antenna system reflector 10 in accordance with the preferred embodiment of our invention. The reflector 10 was designed utilizing computer analysis techniques and may advantageously be constructed of metallized fiberglass, but may be made of any metallized moldable material or other materials well-known in the art. The antenna system described herein utilizing our novel reflector 10 provides a substantially constant 30° elevation beam width from 2 gigahertz to 18 gigahertz. The 2 gigahertz low frequency response of the antenna system is limited in this embodiment of our invention only by the physical size of the reflector which is 12 inches by 20 inches. The 18 gigahertz high frequency response of the antenna system is determined mainly by the particular broadband circularly polarized antenna radiator 11 used to illuminate our reflector. The antenna radiator 11 is not shown in detail in the drawing and many standard electromagnetic radiators may be used to illuminate our reflector. The frequency range of operation of an antenna system incorporating our reflector 10 is determined by the electrical characteristics of the radiator 11, and the physical size of the reflector 10 at the low frequency end of operation, by the mechanical tolerances of the reflector 10 surface and the electrical characteristics of the particular radiator 11 illuminating the reflector at the high frequency end of operation.

In the particular embodiment of our invention disclosed herein a constant beam width azimuth pattern (parallel to the horizon) was not designed. The azimuth half power beam width, only, varies between 4° and 24° over the operating frequency range of 2 gigahertz to 18 gigahertz of the antenna system.

In addition, this particular embodiment of our invention provides an antenna system gain of 20 decibels in the I and J microwave bands of operation.

In the design of our novel reflector 10 we deliberately distort the normal equi-phase characteristics considered in the design of conventional parabolic reflector antenna systems. This was done because the beam width of a conventional parabolic reflector antenna system varies linearly with frequency and would result in a nine to one beam width change over the 2 gigahertz to 18 gigahertz frequency range of operation of our antenna system. This change in beam width would normally be unacceptable for an antenna system, particularly, for example, for an antenna system that may be used for direction finding purposes.

As is well known in the art, the beam width of a parabolic reflector antenna system is determined by the size of the plane wave front at the focal plane of the antenna system in wavelengths or, stating it another way, there is a linear relationship between beam width and antenna aperture size in wavelengths. The linear relationship precludes the possibility of having a constant radiation pattern beam width over a wide frequency range of operation, as the wavefront phase of all field vectors at the focal plane of a parabolic reflector system will add in phase at all frequencies of operation. Accordingly, the resultant radiation pattern of the antenna system will be the normal sin $x/x$ distribution associated with aperture radiation, as is well known in the art.

To achieve constant beam width over a wide frequency band width of operation, a varying phase to amplitude relationship must exist over the operating frequency band width. As all reflectors are geometric devices and are designed using optic principles, particularly the angle of incidence equaling the angle of reflection, equal path length from the electromagnetic energy feed point to the focal plane is achieved independent of frequency. In order to achieve the aforementioned varying phase to amplitude relationship required for a constant beam width radiation pattern, all that is required is to design an antenna reflector that will cause all field vectors to add at the reflector focal plane to provide a constant amplitude versus angle relationship.

To meet the constant elevation beam width pattern criteria described above we designed a novel reflector 10 that can work with a broadband constant beam width electromagnetic radiator 11 such as a spiral, horn, or a dipole.

Figure 2:
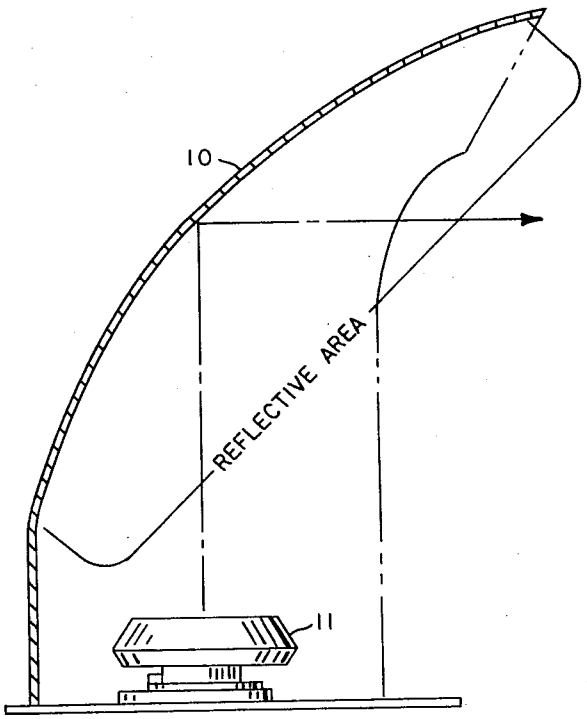
FIG. 2 is a side view of our novel antenna system reflector.
Figure 3:
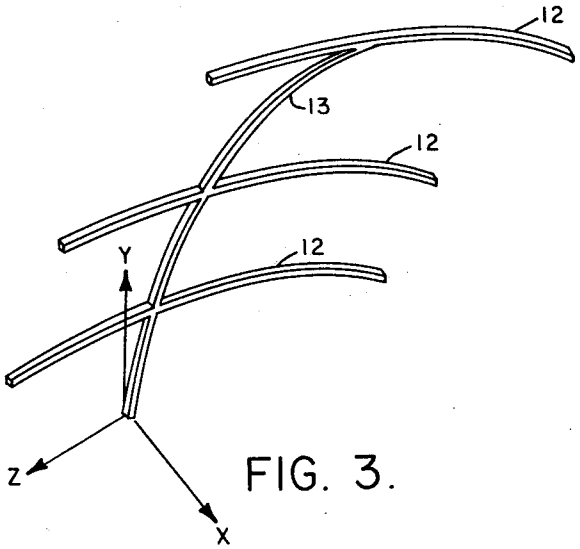
FIG. 3 is a perspective view illustrating the development of the preferred embodiment of our novel antenna system reflector.

Our novel antenna system reflector 10 is a surface described by a family of parabolic curves 12, each curve lying in its own plane, with the physical center of each family of parabolic curves 12 being coincident with the unique backbone curve 13 we have designed such that each of the planes containing each of the family of curves 12 is orthogonal to the plane containing backbone curve 13. Our unique backbone curve 13 can be seen in the side view of our reflector 10 which is shown in FIG. 2. More particularly, FIG. 3 shows the development of our reflector 10 and shows the backbone curve 13. Our unique backbone curve 13 is described by cartesian coordinates which are given immediately herebelow in table 1 and are referenced to the X, Y and Z coordinate axis shown in FIG. 3.

TABLE 1

| X | Y |
|---|---|
| 12.976 inches | 14.617 inches |
| 12.229 | 14.466 |
| 11.495 | 14.266 |
| 10.789 | 14.343 |
| 10.114 | 13.803 |
| 9.468 | 13.549 |
| 8.853 | 13.284 |
| 8.267 | 13.010 |
| 7.710 | 12.728 |
| 7.181 | 12.439 |
| 6.678 | 12.145 |
| 6.232 | 11.847 |
| 5.750 | 11.545 |
| 5.323 | 11.241 |
| 4.919 | 10.935 |
| 4.537 | 10.629 |
| 4.176 | 10.321 |
| 3.837 | 10.014 |
| 3.517 | 9.708 |
| 3.215 | 9.403 |
| 2.932 | 9.100 |
| 2.667 | 8.799 |
| 2.417 | 8.500 |
| 2.184 | 8.205 |
| 1.966 | 7.912 |
| 1.762 | 7.623 |
| 1.572 | 7.338 |
| 1.395 | 7.056 |
| 1.231 | 6.779 |
| 1.078 | 6.505 |
| 0.938 | 6.234 |
| 0.808 | 5.968 |
| 0.689 | 5.705 |
| 0.580 | 5.446 |
| 0.482 | 5.190 |
| 0.393 | 4.939 |
| 0.313 | 4.691 |
| 0.243 | 4.447 |
| 0.181 | 4.206 |
| 0.129 | 3.969 |
| 0.085 | 3.736 |
| 0.050 | 3.506 |
| 0.024 | 3.279 |
| 0.007 | 3.055 |
| 0.004 | 2.835 |
| 0 | 2.617 |

In this embodiment of our invention each of the family of curves 12 that are located along our unique backbone curve 13 comprises a parabola. Rather than describe the parabolic curves at a number of points along our backbone curve 13, immediately herebelow are tables 2 through 11 which, taken along with table 1, detail the surface points of the specific embodiment of our novel reflector 10 tabulated in cartesian coordinates.

TABLE 2

| Z | X | Y |
|---|---|---|
| ± 1.000 inches | 12.995 inches | 14.601 inches |
| | 12.251 | 14.451 |
| | 11.519 | 14.251 |
| | 10.815 | 14.028 |
| | 10.140 | 13.789 |
| | 9.496 | 13.535 |
| | 8.882 | 13.271 |
| | 8.298 | 12.997 |

TABLE 2-continued

| Z | X | Y |
|---|---|---|
| | 7.742 | 12.715 |
| | 7.213 | 12.427 |
| | 6.712 | 12.134 |
| | 6.236 | 11.836 |
| | 5.786 | 11.535 |
| | 5.359 | 11.232 |
| | 4.956 | 10.927 |
| | 4.575 | 10.620 |
| | 4.216 | 10.314 |
| | 3.877 | 10.008 |
| | 3.557 | 9.702 |
| | 3.257 | 9.398 |
| | 2.975 | 9.096 |
| | 2.710 | 8.796 |
| | 2.461 | 8.498 |
| | 2.229 | 8.203 |
| | 2.011 | 7.912 |
| | 1.808 | 7.623 |
| | 1.619 | 7.339 |
| | 1.442 | 7.058 |
| | 1.278 | 6.781 |
| | 1.127 | 6.508 |
| | 0.986 | 6.239 |
| | 0.857 | 5.973 |
| | 0.739 | 5.712 |
| | 0.631 | 5.454 |
| | 0.533 | 5.200 |
| | 0.444 | 4.950 |
| | 0.365 | 4.703 |
| | 0.295 inches | 4.461 inches |
| | 0.234 | 4.222 |
| | 0.182 | 3.987 |
| | 0.139 | 3.756 |
| | 0.104 | 3.528 |
| | 0.078 | 3.304 |
| | 0.062 | 3.084 |
| | 0.058 | 2.869 |
| | 0.055 | 2.661 |

TABLE 3

| Z | X | Y |
|---|---|---|
| ± 2.000 inches | 13.053 inches | 14.552 inches |
| | 12.320 | 14.404 |
| | 11.592 | 14.205 |
| | 10.892 | 13.984 |
| | 10.221 | 13.746 |
| | 9.580 | 13.494 |
| | 8.970 | 13.231 |
| | 8.388 | 12.958 |
| | 7.835 | 12.678 |
| | 7.310 | 12.392 |
| | 6.812 | 12.100 |
| | 6.339 | 11.804 |
| | 5.892 | 11.505 |
| | 5.468 | 11.203 |
| | 5.068 | 10.900 |
| | 4.689 | 10.596 |
| | 4.333 | 10.292 |
| | 3.996 | 9.988 |
| | 3.680 | 9.685 |
| | 3.382 | 9.383 |
| | 3.102 | 9.083 |
| | 2.839 | 8.786 |
| | 2.593 | 8.490 |
| | 2.363 | 8.198 |
| | 2.147 | 7.909 |
| | 1.946 | 7.623 |
| | 1.758 | 7.341 |
| | 1.584 | 7.063 |
| | 1.422 | 6.789 |
| | 1.272 | 6.519 |
| | 1.133 | 6.253 |
| | 1.006 | 5.991 |
| | 0.889 | 5.733 |
| | 0.783 | 5.479 |
| | 0.686 | 5.228 |
| | 0.599 | 4.982 |
| | 0.522 | 4.740 |
| | 0.453 | 4.502 |
| | 0.393 | 4.269 |
| | 0.343 | 4.039 |
| | 0.300 inches | 3.815 inches |
| | 0.267 | 3.596 |
| | 0.243 | 3.381 |
| | 0.227 | 3.171 |
| | 0.222 | 2.970 |

TABLE 3-continued

| Z | X | Y |
|---|---|---|
| | 0.220 | 2.794 |

TABLE 4

| Z | X | Y |
|---|---|---|
| ± 3.000 inches | 13.150 inches | 14.471 inches |
| | 12.433 | 14.327 |
| | 11.713 | 14.130 |
| | 11.020 | 13.911 |
| | 10.355 | 13.674 |
| | 9.721 | 13.425 |
| | 9.115 | 13.164 |
| | 8.539 | 12.894 |
| | 7.992 | 12.616 |
| | 7.472 | 12.332 |
| | 6.978 | 12.043 |
| | 6.511 | 11.750 |
| | 6.068 | 11.454 |
| | 5.649 | 11.156 |
| | 5.254 | 10.857 |
| | 4.880 | 10.556 |
| | 4.528 | 10.256 |
| | 4.196 | 9.955 |
| | 3.884 | 9.656 |
| | 3.590 | 9.358 |
| | 3.314 | 9.063 |
| | 3.055 | 8.769 |
| | 2.813 | 8.478 |
| | 2.586 | 8.190 |
| | 2.374 | 7.905 |
| | 2.176 | 7.623 |
| | 1.991 | 7.346 |
| | 1.819 | 7.072 |
| | 1.660 | 6.803 |
| | 1.513 | 6.538 |
| | 1.378 | 6.277 |
| | 1.253 | 6.020 |
| | 1.139 | 5.768 |
| | 1.035 | 5.520 |
| | 0.941 | 5.276 |
| | 0.857 | 5.036 |
| | 0.782 | 4.802 |
| | 0.716 | 4.572 |
| | 0.659 inches | 4.347 inches |
| | 0.610 | 4.127 |
| | 0.570 | 3.914 |
| | 0.539 | 3.708 |
| | 0.516 | 3.508 |
| | 0.502 | 3.316 |
| | 0.498 | 3.138 |
| | 0.496 | 3.015 |

TABLE 5

| Z | X | Y |
|---|---|---|
| ± 4.000 inches | 13.285 inches | 14.358 inches |
| | 12.592 | 14.218 |
| | 11.884 | 14.024 |
| | 11.199 | 13.808 |
| | 10.543 | 13.575 |
| | 9.917 | 13.328 |
| | 9.319 | 13.070 |
| | 8.751 | 12.803 |
| | 8.210 | 12.529 |
| | 7.698 | 12.249 |
| | 7.211 | 11.964 |
| | 6.751 | 11.675 |
| | 6.315 | 11.384 |
| | 5.903 | 11.090 |
| | 5.514 | 10.795 |
| | 5.147 | 10.500 |
| | 4.802 | 10.204 |
| | 4.476 | 9.910 |
| | 4.169 | 9.616 |
| | 3.882 | 9.324 |
| | 3.611 | 9.033 |
| | 3.358 | 8.746 |
| | 3.121 | 8.460 |
| | 2.898 | 8.178 |
| | 2.691 | 7.899 |
| | 2.497 | 7.623 |
| | 2.317 | 7.352 |
| | 2.149 | 7.085 |
| | 1.994 | 6.822 |

TABLE 5-continued

| Z | X | Y |
|---|---|---|
| | 1.851 | 6.564 |
| | 1.720 | 6.310 |
| | 1.599 | 6.061 |
| | 1.489 | 5.817 |
| | 1.389 | 5.577 |
| | 1.299 | 5.342 |
| | 1.218 | 5.112 |
| | 1.147 | 4.888 |
| | 1.084 | 4.669 |
| | 1.030 inches | 4.456 inches |
| | 0.984 | 4.250 |
| | 0.948 | 4.053 |
| | 0.919 | 3.865 |
| | 0.899 | 3.686 |
| | 0.887 | 3.519 |
| | 0.882 | 3.374 |
| | 0.878 | 3.325 |

TABLE 6

| Z | X | Y |
|---|---|---|
| ± 5.000 inches | 13.459 inches | 14.212 inches |
| | 12.796 | 14.079 |
| | 12.102 | 13.889 |
| | 11.430 | 13.676 |
| | 10.785 | 13.446 |
| | 10.169 | 13.203 |
| | 9.581 | 12.949 |
| | 9.022 | 12.687 |
| | 8.492 | 12.417 |
| | 7.988 | 12.142 |
| | 7.511 | 11.662 |
| | 7.060 | 11.579 |
| | 6.633 | 11.293 |
| | 6.230 | 11.205 |
| | 5.849 | 10.716 |
| | 5.491 | 10.427 |
| | 5.153 | 10.139 |
| | 4.835 | 9.851 |
| | 4.537 | 9.564 |
| | 4.256 | 9.279 |
| | 3.993 | 8.996 |
| | 3.747 | 8.716 |
| | 3.516 | 8.438 |
| | 3.300 | 8.163 |
| | 3.099 | 7.892 |
| | 2.910 | 7.623 |
| | 2.735 | 7.359 |
| | 2.573 | 7.100 |
| | 2.424 | 6.846 |
| | 2.286 | 6.597 |
| | 2.160 | 6.353 |
| | 2.044 | 6.114 |
| | 1.939 | 5.880 |
| | 1.844 | 5.651 |
| | 1.759 | 5.428 |
| | 1.682 | 5.210 |
| | 1.615 inches | 4.999 inches |
| | 1.557 | 4.794 |
| | 1.507 | 4.597 |
| | 1.466 | 4.408 |
| | 1.433 | 4.232 |
| | 1.408 | 4.067 |
| | 1.391 | 3.915 |
| | 1.381 | 3.780 |
| | 1.378 | 3.677 |
| | 1.370 | 3.723 |

TABLE 7

| Z | X | Y |
|---|---|---|
| ± 6.000 inches | 13.672 inches | 14.033 inches |
| | 13.046 | 13.908 |
| | 12.369 | 13.723 |
| | 11.712 | 13.514 |
| | 11.081 | 13.289 |
| | 10.477 | 13.051 |
| | 9.902 | 12.802 |
| | 9.355 | 12.545 |
| | 8.836 | 12.281 |
| | 8.343 | 12.011 |
| | 7.878 | 11.738 |
| | 7.437 | 11.461 |
| | 7.021 | 11.182 |

TABLE 7-continued

| Z | X | Y |
|---|---|---|
| | 6.629 | 10.901 |
| | 6.259 | 10.620 |
| | 5.911 | 10.339 |
| | 5.583 | 10.058 |
| | 5.275 | 9.779 |
| | 4.986 | 9.500 |
| | 4.714 | 9.224 |
| | 4.460 | 8.950 |
| | 4.222 | 8.679 |
| | 3.999 | 8.410 |
| | 3.791 | 8.145 |
| | 3.597 | 7.882 |
| | 3.416 | 7.623 |
| | 3.247 | 7.369 |
| | 3.092 | 7.120 |
| | 2.949 | 6.876 |
| | 2.818 | 6.638 |
| | 2.698 | 6.405 |
| | 2.588 | 6.178 |
| | 2.489 | 5.957 |
| | 2.400 inches | 5.741 inches |
| | 2.320 | 5.532 |
| | 2.250 | 5.330 |
| | 2.188 | 5.134 |
| | 2.135 | 4.947 |
| | 2.090 | 4.768 |
| | 2.054 | 4.601 |
| | 2.026 | 4.450 |
| | 2.006 | 4.314 |
| | 1.993 | 4.195 |
| | 1.986 | 4.099 |
| | 1.984 | 4.047 |
| | 1.971 | 4.210 |

TABLE 8

| Z | X | Y |
|---|---|---|
| ± 7.000 inches | 13.924 inches | 13.822 inches |
| | 13.341 | 13.707 |
| | 12.685 | 13.527 |
| | 12.046 | 13.324 |
| | 11.430 | 13.104 |
| | 10.841 | 12.871 |
| | 10.280 | 12.628 |
| | 9.747 | 12.377 |
| | 9.242 | 12.119 |
| | 8.763 | 11.857 |
| | 8.311 | 11.591 |
| | 7.883 | 11.321 |
| | 7.480 | 11.051 |
| | 7.100 | 10.779 |
| | 6.743 | 10.506 |
| | 6.407 | 10.234 |
| | 6.091 | 9.963 |
| | 5.794 | 9.693 |
| | 5.516 | 9.425 |
| | 5.256 | 9.160 |
| | 5.012 | 8.896 |
| | 4.784 | 8.636 |
| | 4.571 | 8.378 |
| | 4.372 | 8.123 |
| | 4.186 | 7.872 |
| | 4.013 | 7.624 |
| | 3.852 | 7.380 |
| | 3.705 | 7.143 |
| | 3.569 | 6.911 |
| | 3.446 | 6.686 |
| | 3.333 inches | 6.467 inches |
| | 3.231 | 6.254 |
| | 3.139 | 6.047 |
| | 3.057 | 5.848 |
| | 2.984 | 5.656 |
| | 2.920 | 5.471 |
| | 2.865 | 5.294 |
| | 2.818 | 5.127 |
| | 2.780 | 4.971 |
| | 2.749 | 4.830 |
| | 2.727 | 4.708 |
| | 2.713 | 4.606 |
| | 2.704 | 4.525 |
| | 2.701 | 4.476 |
| | 2.700 | 4.427 |
| | 2.682 | 4.378 |

TABLE 9

| Z | X | Y |
|---|---|---|
| ± 8.000 inches | 14.214 inches | 13.579 inches |
| | 13.681 | 13.474 |
| | 13.050 | 13.301 |
| | 12.430 | 13.103 |
| | 11.833 | 12.890 |
| | 11.261 | 12.663 |
| | 10.717 | 12.427 |
| | 10.200 | 12.183 |
| | 9.711 | 11.933 |
| | 9.248 | 11.679 |
| | 8.810 | 11.421 |
| | 8.398 | 11.161 |
| | 8.010 | 10.899 |
| | 7.644 | 10.637 |
| | 7.301 | 10.375 |
| | 6.979 | 10.114 |
| | 6.677 | 9.853 |
| | 6.394 | 9.595 |
| | 6.128 | 9.339 |
| | 5.880 | 9.085 |
| | 5.649 | 8.834 |
| | 5.432 | 8.586 |
| | 5.230 | 8.340 |
| | 5.041 | 8.098 |
| | 4.865 | 7.859 |
| | 4.702 | 7.624 |
| | 4.550 | 7.393 |
| | 4.412 inches | 7.169 inches |
| | 4.285 | 6.952 |
| | 4.170 | 6.741 |
| | 4.067 | 6.538 |
| | 3.973 | 6.341 |
| | 3.889 | 6.152 |
| | 3.815 | 5.971 |
| | 3.750 | 5.798 |
| | 3.694 | 5.634 |
| | 3.646 | 5.479 |
| | 3.607 | 5.336 |
| | 3.575 | 5.206 |
| | 3.552 | 5.093 |
| | 3.536 | 5.005 |
| | 3.528 | 4.943 |
| | 3.525 | 4.907 |
| | 3.525 | 4.871 |
| | 3.527 | 4.835 |
| | 3.501 | 4.799 |

TABLE 10

| Z | X | Y |
|---|---|---|
| ± 9.000 inches | 14.542 inches | 13.303 inches |
| | 14.067 | 13.211 |
| | 13.463 | 13.044 |
| | 12.866 | 12.854 |
| | 12.290 | 12.647 |
| | 11.738 | 12.428 |
| | 11.212 | 12.199 |
| | 10.714 | 11.964 |
| | 10.242 | 11.722 |
| | 9.797 | 11.477 |
| | 9.377 | 11.228 |
| | 8.981 | 10.978 |
| | 8.610 | 10.727 |
| | 8.261 | 10.476 |
| | 7.934 | 10.226 |
| | 7.628 | 9.977 |
| | 7.341 | 9.729 |
| | 7.073 | 9.484 |
| | 6.822 | 9.241 |
| | 6.588 | 9.001 |
| | 6.370 | 8.763 |
| | 6.167 | 8.529 |
| | 5.977 | 8.298 |
| | 5.800 | 8.070 |
| | 5.636 inches | 7.845 inches |
| | 5.482 | 7.624 |
| | 5.341 | 7.407 |
| | 5.213 | 7.199 |
| | 5.097 | 6.998 |
| | 4.992 | 6.804 |
| | 4.898 | 6.618 |
| | 4.814 | 6.441 |
| | 4.740 | 6.271 |
| | 4.675 | 6.111 |
| | 4.619 | 5.959 |
| | 4.571 | 5.818 |
| | 4.532 | 5.688 |
| | 4.500 | 5.572 |

TABLE 10-continued

| Z | X | Y |
|---|---|---|
| | 4.477 | 5.471 |
| | 4.461 | 5.392 |
| | 4.453 | 5.343 |
| | 4.452 | 5.325 |
| | 4.455 | 5.307 |
| | 4.460 | 5.289 |
| | 4.463 | 5.271 |
| | 4.430 | 5.253 |

TABLE 11

| Z | X | Y |
|---|---|---|
| ± 10.000 inches | 14.910 inches | 12.995 inches |
| | 14.498 | 12.916 |
| | 13.925 | 12.758 |
| | 13.353 | 12.575 |
| | 12.800 | 12.376 |
| | 12.270 | 12.165 |
| | 11.766 | 11.945 |
| | 11.288 | 11.718 |
| | 10.836 | 11.486 |
| | 10.410 | 11.251 |
| | 10.010 | 11.013 |
| | 9.633 | 10.775 |
| | 9.281 | 10.536 |
| | 8.950 | 10.297 |
| | 8.641 | 10.060 |
| | 8.353 | 9.824 |
| | 8.083 | 9.590 |
| | 7.832 | 9.359 |
| | 7.598 | 9.131 |
| | 7.380 | 8.906 |
| | 7.176 | 8.684 |
| | 6.988 | 8.466 |
| | 6.812 | 8.250 |
| | 6.648 | 8.038 |
| | 6.496 | 7.829 |
| | 6.355 | 7.624 |
| | 6.225 | 7.424 |
| | 6.108 | 7.232 |
| | 6.003 | 7.049 |
| | 5.910 | 6.874 |
| | 5.827 | 6.708 |
| | 5.753 | 6.552 |
| | 5.690 | 6.404 |
| | 5.635 | 6.267 |
| | 5.589 | 6.140 |
| | 5.551 | 6.024 |
| | 5.521 | 5.922 |
| | 5.499 | 5.836 |
| | 5.484 | 5.768 |
| | 5.477 | 5.725 |
| | 5.478 | 5.719 |
| | 5.485 | 5.713 |
| | 5.494 | 5.707 |
| | 5.504 | 5.701 |
| | 5.510 | 5.695 |
| | 5.469 | 5.689 |

The unique backbone curve, and the family of parabolic curves which describe our novel reflector may be physically extended to enlarge the reflector surface from that described above to provide constant beam width operation below two gigahertz. In addition, the edges of the reflector are shaped depending on the beam width of the electromagnetic radiator illuminating the reflector, to adjust antenna sidelobes, and to adjust antenna system gain and beam width, as is well known in the art.

In many antenna system designs utilizing reflectors the feed element illuminating the reflector is not located at the focal point of the reflector, which lies in the pattern of the antenna system, but is offset from the focal point thereof to minimize inherrent disruption of the pattern by the radiator. In the embodiment of our invention disclosed herein, we offset the electromagnetic radiator 11 to a point 10.629 inches below the reflector 10 as shown in FIG. 2. The radiator 11 is aimed upward and, to simplify the antenna system design, remains stationary while the reflector 10 is rotated about radiator 11. This can be accomplished because, as pointed out previously in this specification, electromagnetic radiator 11 provides a circular pattern and so provides the same illumination pattern on the reflector as it rotates. In addition, the polarization of electromagnetic radiator 11 is circular in this embodiment of our invention so the same electromagnetic field vector orientation will be maintained as reflector 10 rotates about radiator 11. It can be recognized by one skilled in the art, however, that the amount of radiator 11 offset may be varied and polarization may be varied depending upon the design criteria of an antenna system while still utilizing a reflector and, in particular, our novel reflector 10.

In relocating the electromagnetic radiator 11 from the location shown in FIG. 3 for the specific embodiment of our invention disclosed herein, the reflector 10 surface changes. To compute the new surface, the backbone curve coordinates given in table 1 are first divided by the focal length of the reflector disclosed herein, which is 10.629 inches. This givves the normalized coordinates listed in table 12 below.

TABLE 12

| X | Y |
|---|---|
| 1.2208106 inches | 1.37520 inches |
| 1.1505312 | 1.36100 |
| 1.0814748 | 1.34218 |
| 1.0150528 | 1.32120 |
| 0.9515473 | 1.29862 |
| 0.8907702 | 1.27472 |
| 0.8329097 | 1.24979 |
| 0.7777775 | 1.22401 |
| 0.7253737 | 1.19748 |
| 0.6756042 | 1.17029 |
| 0.6282809 | 1.14262 |
| 0.5834978 | 1.11459 |
| 0.5409726 | 1.08618 |
| 0.5007995 | 1.05758 |
| 0.4627903 | 1.02879 |
| 0.4268509 | 1.00000 |
| 0.3928872 | 0.97102 |
| 0.3609934 | 0.94214 |
| 0.330887 | 0.91335 |
| 0.3024742 | 0.88465 |
| 0.275849 | 0.85615 |
| 0.2509172 | 0.82783 |
| 0.2273966 | 0.79970 |
| 0.2054755 | 0.77194 |
| 0.1849656 | 0.74438 |
| 0.1657728 | 0.71719 |
| 0.1478972 | 0.69038 |
| 0.1312446 | 0.66384 |
| 0.1158151 | 0.63778 |
| 0.1014206 | 0.61200 |
| 0.0882491 | 0.58651 |
| 0.0760184 | 0.56148 |
| 0.0648226 | 0.53674 |
| 0.0545676 | 0.51238 |
| 0.0453476 | 0.48829 |
| 0.0369743 | 0.46467 |
| 0.0294477 | 0.44134 |
| 0.0228619 | 0.41838 |
| 0.0170288 | 0.39571 |
| 0.0121366 | 0.37341 |
| 0.0079969 | 0.35149 |
| 0.0047041 | 0.32985 |
| 0.0022579 | 0.30850 |
| 0.0006585 | 0.28742 |
| 0.0003763 | 0.26672 |
| 0 | 0.24621 |

Each of the normalized coordinates in table 12 is then multiplied by the desired focal length, in inches, of the new antenna to get the backbone curve for the reflector. To calculate the coordinate information for the remainder of the new reflector surface, the coordinate information in tables 2 through 11 herein is multiplied by the ratio of desired focal length to original focal length. Again, the edges of the new reflector are extended or contracted, as well known by one skilled in the art, to determine low frequency response, reflector gain beam width and sidelobes of the new antenna system.

Although the present invention has been described in the specific embodiment disclosed herein, nevertheless various changes and modifications would be obvious to those skilled in the art that are within the scope and contemplation of this invention. It will be apparent that many such changes can be made to the disclosed embodiment without departing from the basic concept of a reflector built up from our unique backbone curve. Thus, for example, the family of curves which are disclosed herein as being orthogonal to the backbone curve to make up the reflector surface need not be parabolic and need not be curves at all, but could be straight lines.

What is claimed is:

1. An antenna reflector surface described by a first curve derived by multiplying each of the cartesian coordinate defined points listed below by the focal length in inches of the reflector

TABLE 12

| X | Y |
|---|---|
| 1.2208106 inches | 1.37520 inches |
| 1.1505312 | 1.36100 |
| 1.0814748 | 1.34218 |
| 1.0150528 | 1.32120 |
| 0.9515473 | 1.29862 |
| 0.8907702 | 1.27472 |
| 0.8329097 | 1.24979 |
| 0.7777775 | 1.22401 |
| 0.7253737 | 1.19748 |
| 0.6756042 | 1.17029 |
| 0.6282809 | 1.14262 |
| 0.5834978 | 1.11459 |
| 0.5409726 | 1.08618 |
| 0.5007995 | 1.05758 |
| 0.4627903 | 1.02879 |
| 0.4268509 | 1.00000 |
| 0.3928872 | 0.97102 |
| 0.3609934 | 0.94214 |
| 0.330887 | 0.91335 |
| 0.3024742 | 0.88465 |
| 0.275849 | 0.85615 |
| 0.2509172 | 0.82783 |
| 0.2273966 | 0.79970 |
| 0.2054755 | 0.77194 |
| 0.1849656 | 0.74438 |
| 0.1657728 | 0.71719 |
| 0.1478972 | 0.69038 |
| 0.1312446 | 0.66384 |
| 0.1158151 | 0.63778 |
| 0.1014206 | 0.61200 |
| 0.0882491 | 0.58651 |
| 0.0760184 | 0.56148 |
| 0.0648226 | 0.53674 |
| 0.0545676 | 0.51238 |
| 0.0453476 | 0.48829 |
| 0.0369743 | 0.46467 |
| 0.0294477 | 0.44134 |
| 0.0228619 | 0.41838 |
| 0.0170288 | 0.39571 |
| 0.0121366 | 0.37341 |
| 0.0079969 | 0.35149 |
| 0.0047041 | 0.32985 |
| 0.0022579 | 0.30850 |
| 0.0006585 | 0.28742 |
| 0.0003763 | 0.26672 |
| 0 | 0.24621 |

where the focal length of the reflector is the distance in inches from a feed illuminating said reflector to the central point of said first curve and the remainder of the reflector surface is described by a family of curves, each curve lying in its own planar surface, with the physical center of each of the family of curves coinciding with a point on said first curve and the planar surfaces containing each of the family of curves orthogonal to the plane containing said first curve and said antenna reflector surface providing constant elevation beam width for any frequency of radiation illuminating said reflector surface.

2. The antenna reflector in accordance with claim 1 wherein each of the family of curves defining the reflector surface are parabolic curves.

3. The antenna reflector in accordance with claim 2 wherein said antenna reflector has a focal length of 10.629 inches and the reflector surface is defined by the cartesian coordinate information in tables 1, 2, 3, 4, 5, 6, 7, 8, 9, 10 and 11 in the specification of this patent, and wherein the edges of the reflector surface so defined may be extended or contracted depending upon the desired beam width of the radiation pattern reflected by said reflector.

4. An antenna system comprising a reflector and a radiator for illuminating said reflector with energy wherein said reflector is a surface described by a first curve derived by multiplying each of the cartesian coordinate defined points listed below by the focal length in inches of the reflector

TABLE 12

| X | Y |
|---|---|
| 1.2208106 inches | 1.37520 inches |
| 1.1505312 | 1.36100 |
| 1.0814748 | 1.34218 |
| 1.0150528 | 1.32120 |
| 0.9515473 | 1.29862 |
| 0.8907702 | 1.27472 |
| 0.8329097 | 1.24979 |
| 0.7777775 | 1.22401 |
| 0.7253737 | 1.19748 |
| 0.6756042 | 1.17029 |
| 0.6282809 | 1.14262 |
| 0.5834978 | 1.11459 |
| 0.5409726 | 1.08618 |
| 0.5007995 | 1.05758 |
| 0.4627903 | 1.02879 |
| 0.4268509 | 1.00000 |
| 0.3928872 | 0.97102 |
| 0.3609934 | 0.94214 |
| 0.330887 | 0.91335 |
| 0.3024742 | 0.88465 |
| 0.275849 | 0.85615 |
| 0.2509172 | 0.82783 |
| 0.2273966 | 0.79970 |
| 0.2054755 | 0.77194 |
| 0.1849656 | 0.74438 |
| 0.1657728 | 0.71719 |

TABLE 12-continued

| X | Y |
|---|---|
| 0.1478972 | 0.69038 |
| 0.1312446 | 0.66384 |
| 0.1158151 | 0.63778 |
| 0.1014206 | 0.61200 |
| 0.0882491 | 0.58651 |
| 0.0760184 | 0.56148 |
| 0.0648226 | 0.53674 |
| 0.0545676 | 0.51238 |
| 0.0453476 | 0.48829 |
| 0.0369743 | 0.46467 |
| 0.0294477 | 0.44134 |
| 0.0228619 | 0.41838 |
| 0.0170288 | 0.39571 |
| 0.0121366 | 0.37341 |
| 0.0079969 | 0.35149 |
| 0.0047041 | 0.32985 |
| 0.0022579 | 0.30850 |
| 0.0006585 | 0.28742 |
| 0.0003763 | 0.26672 |
| 0 | 0.24621 |

where the focal length of the reflector is 10.629 inches and the remainder of the reflector surface is described by a family of curves, each curve lying in its own planar surface, with the physical center of each of said family of curves coinciding with a point on said first curve and the planar surface containing each of said family of curves orthogonal to the plane containing said first curve, and said antenna reflector surface providing constant elevation beam width for any frequency of radiation illuminating said reflector surface.

5. The antenna system in accordance with claim 4 wherein the focal length of said reflector surface is 10.629 inches and each of said family of curves are parabolic curves defining a reflector surface corresponding to the cartesian coordinate information contained in tables 1, 2, 3, 4, 5, 6, 7, 8, 9, 10 and 11 in the specification of this patent.

6. The antenna system in accordance with claim 5 wherein the edges of the reflector surface are extended or contracted depending upon the beam width of the radiation pattern reflected by said reflector and the range of frequencies over which constant elevation beam width is to be obtained.

7. The antenna system in accordance with claim 6 wherein said radiator illuminating said reflector radiates energy directionally.

8. The antenna system in accordance with claim 7 wherein said radiator radiates circularly polarized electromagnetic energy.

* * * * *